US005525255A

United States Patent [19]

Leadingham et al.

[11] Patent Number: 5,525,255

[45] Date of Patent: Jun. 11, 1996

[54] NEUTRAL CLEANING AGENT AND METHOD OF MAKING IT

[76] Inventors: David R. Leadingham, 1216 N. LaSalle, Chicago, Ill. 60610; Charles J. Latta, 2 S. 310 Center, Wheaton, Ill. 60187

[21] Appl. No.: 433,250

[22] Filed: Apr. 28, 1995

(Under 37 CFR 1.47)

[51] Int. Cl.[6] ..... C11D 3/386

[52] U.S. Cl. ..... 252/174.12; 252/106; 252/553; 252/554; 252/DIG. 12; 435/220

[58] Field of Search ..... 252/106, 174.12, 252/553, 554, DIG. 12; 435/220

[56] References Cited

U.S. PATENT DOCUMENTS 4,541,944 9/1985 Sanderson ..... 252/95
5,156,761 10/1992 Asalyng et al. ..... 252/174.12
5,156,773 10/1992 Kochavi et al. ..... 252/547
5,336,500 8/1994 Richter et al. ..... 424/408
5,419,908 5/1995 Richter et al. ..... 424/408

*Primary Examiner*—Paul Lieberman
*Assistant Examiner*—Necholus Ogden
*Attorney, Agent, or Firm*—Bernard L. Kleinke; Jerry R. Potts; Peter P. Scott

[57] ABSTRACT

A safe and effective, neutral, non-toxic cleaning agent composition containing a surfactant, nonylphenol ethoxylate, and a wetting agent alkane sulfonate, for rapidly and economically removing oils and greases. The composition is safe in handling, and enables more rapid oil and grease removal than prior art cleaners. The composition is aqueous based, and therefore more environmentally safe and able to be used in conjunction with biodegradation systems without detrimentally effecting microorganisms performing the breakdown of waste.

6 Claims, No Drawings

NEUTRAL CLEANING AGENT AND METHOD OF MAKING IT

CROSS-REFERENCE TO RELATED APPLICATION

A co-pending U.S. patent application, entitled "WASTE HYDROCARBON TREATMENT SYSTEM AND METHOD OF USING SAME," Ser. No. 08/431,122, filed Apr. 28, 1995, is incorporated herein by reference as if fully set forth herein.

TECHNICAL FIELD

The present invention relates in general to neutral cleaning agents and methods of making them. More particularly, the present invention relates to a neutral, non-toxic cleaning agent for removing fats, oils, dirt, grease and other such substances, from surfaces to be cleaned in an efficient manner. The cleaning agents, and the method for preparing them, are particularly well suited for use in cleaning hydrocarbons. The hydrocarbon and cleaning solution mixture can be safely disposed of by introducing it to the treatment system disclosed in the foregoing patent application, which system can treat the mixture to render it safe for drainage into a sewer line, without the need for disposing of the toxic hydrocarbon mixture according to costly toxic waste disposal procedures.

BACKGROUND ART

Traditionally, cleaning agents formulated to clean oil and grease have been mineral spirit or organic solvent based. While effective cleaners, these agents are well known to be toxic and in most instances should not be brought in contact with human skin, because of their harsh chemical nature. Additionally, many of these organic compounds are highly volatile and give off noxious fumes. For this reason, the use of these cleaning agents must occur in well ventilated areas or confined to fume exhaust hoods. Therefore, it would be highly desirable to have a new and improved cleaning agent, which is adapted to remove oils, greases and other unwanted substances, and which is neutral and non-toxic.

The removal of dirt and grease from vehicle parts is commonplace in vehicle repair facilities. This operation often involves manually cleaning a part with a parts washer. The conventional vehicle parts washer includes a basin having cleaning devices and a pump for recirculating a cleaning agent from which dirt and particulates have been removed by filtration. In this regard, the use of an organic solvent based cleaning agent could result in the cleaning agent coming into contact with the skin of a person using the washer, and the fumes could be inhaled by the user. Therefore, it would be highly desirable to have a new and improved non-toxic, non-volatile, safe cleaning agent for use in parts washers and other related applications, where the cleaning agent was highly effective in the cleaning of the parts.

In order to maintain a safe work environment, vehicle maintenance facilities, and the like, must routinely scrub the soiled floor to remove waste, oil and grease therefrom. This is normally accomplished by utilization of a floor scrubber, either a hand operated scrubber or a self-propelled vehicle scrubber. The operation of a conventional floor scrubber generates large quantities of used cleaning agents mixed with oil and grease removed from the floor. Disposal of this waste can be difficult and costly. Therefore, it would be highly desirable to have a new and improved nontoxic, effective cleaning agent, which can be employed in floor scrubbers, and which, when used, can result in a readily disposed of residue.

With more and more hydrocarbon contaminated waste being generated by vehicle maintenance facilities, and the like, there is a pressing need for efficient, cost effective removal of the organic contaminants. When organic solvent cleaning agents are employed, the resulting oil/solvent wastes must be disposed of using conventional methods such as burial, landfill, dumping at sea and incineration. These disposal methods constitute a toxic threat to the environment. Thus, they usually are required to be disposed of according to the expensive toxic waste removal procedures.

The treating system of the foregoing patent application helps dispose of hydrocarbon contaminated wastes by utilizing bioprocessing remediation techniques and apparatus. These methods include aerobic bacterial biodegradation of hydrocarbons. Hydrocarbon utilizing bacteria convert the organic waste intermediate metabolites, often compounds with simple structures, which are not a threat to the environment. In some cases, bacterial metabolism of organic waste reduces hydrocarbons to their most basic elements carbon dioxide and water.

As disclosed in the foregoing patent application, the process of biodegradation takes place in a bioreactor. A bioreactor facilitates the growth of microorganisms by providing an aerobic environment, nutrients and a high surface area physical structure to support a large biomass within a bioreaction zone. The microorganisms must thrive within the bioreactor in order to effectively and efficiently biodegrade in flowing waste hydrocarbons. Since conventional cleaning agents include ingredients which will inhibit the growth of most microorganisms, and in many instances, especially with harsh organic solvents, effectively kill the microorganisms, such conventional cleaning agents are not suitable for use in the biological treating system. Therefore, it would be highly desirable to have a new and improved cleaning agent, which is non-toxic, and which, when used in conjunction with biodegradation processes, do not interfere with the proliferation of the microorganisms.

DISCLOSURE OF INVENTION

It is an object of the present invention to provide a new and improved cleaning agent composition and method of making it for effectively removing oils, greases and the like substances, which composition is neutral and non-toxic.

It is a further object of the present invention to provide such a method and composition which could be utilized safely and economically in conjunction with parts washers and floor scrubbers, or the like, to effectively and efficiently remove oils and greases from parts and floors, respectively.

It is still a further object of the present invention to provide such a method cleaning agent composition, which is neutral and non-toxic, such that when used in conjunction with hydrocarbon biodegradation processes, the growth of microorganisms is not interfered with, for accomplishing biodegradation of wastes or the like.

Therefore, according to the present invention, there is provided a safe and effective, neutral, non-toxic cleaning agent composition containing a surfactant, nonylphenol ethoxylate, and a wetting agent alkane sulfonate, for rapidly and economically removing oils and greases.

An advantage of the present invention is seen in the fact that the composition is safe in handling, and enables more rapid oil and grease removal than prior art cleaners.

A further advantage of the present invention is that it is aqueous based, and therefore more environmentally safe and able to be used in conjunction with biodegradation systems without detrimentally effecting to any great extent microorganisms performing the breakdown of waste.

A still further advantage of the present invention is that it is substantially less expensive to use in cleaning, per square foot of surface to be cleaned, than prior known degreasing agents.

BEST MODE FOR CARRYING OUT THE INVENTION

The following examples are given to aid in understanding the invention, but it is to be understood that the particular procedures, conditions and materials of these examples are not intended as limitations of the present invention.

EXAMPLE I

5% by volume nonylphenol ethoxylate 9.5 Mole (Texaco Surfonic)

2% by volume nonylphenol ethoxylate 4.0 Mole (Texaco Surfonic)

3% by volume alkane sulfonate (Stepan BioTerge PAS)

90% by volume water

The foregoing Example lists the percentage by volume of the proper ingredients in addition order. The composition of the present invention is prepared by adhering to the following steps:

1. Add two parts of Texaco surfonic nonylphenol ethoxylate 4.0 Mole to five parts of Texaco surfonic nonylphenol ethoxylate 9.5 Mole, and mix well.

2. Add three parts of Stepan BioTerge™ PAS alkane sulfonate to the above mixture and mix well by conventional mixing techniques.

3. Add 90 parts water to the above mixture and mix well by conventional techniques. In this manner, it has been found that by adding the 4.0 Texaco Surfonic Mole nonylphenol ethoxylate to the 9.5 Mole Texaco Surfonic nonylphenol ethoxylate, prior to the addition of the BioTerge™ PAS alkane sulfonate, the ingredients can be more readily mixed more thoroughly and conveniently with the water. The resulting cleaning agent is neutral and is non-toxic. In general, it achieves all of the foregoing objects of the present invention.

This method of making Example I is preferred, and it has been found to exhibit the preferred results to achieve the objects of the invention.

It would facilitate greater flowability and better blending to raise the temperature of the respective components to between 80° F. and 115° F. before mixing takes place. The resulting composition can be shipped and stored at room temperature.

By pre-heating, the flowability of the nonylphenol ethoxylate ingredients is increased advantageously.

Texaco Surfonic nonylphenol ethoxylate (CAS 9016-45-9) is available from Texaco, Inc. Additionally, BioTerge PAS alkane sulfonate (CAS 5234-84-5) is available from Stepan Chemical Company.

The nonylphenol ethoxylate is a non-ionic surfactant, and serves as a releasing agent to remove fats, oils, and greases from the surfaces of objects. The alkane sulfonate serves as a wetting agent to prevent the re-adherence of removed fats, oils, and grease to the surfaces. The water serves as a vehicle for transporting the nonylphenol ethoxylate and the alkane sulfonate.

EXAMPLE II

5% by volume nonylphenol ethoxylate 9.5 mole (Texaco Surfonic)

2% by volume nonylphenol ethoxylate 4.0 mole (Texaco Surfonic)

3% by volume alkane ethoxylate sulfonate (Bio Terge PAS)

trace of BioBlend M-B4W balance water

The composition of this example includes a mixture of the neutral, non-toxic cleaning agent of Example I, wherein a sufficient amount of BioBlend M-B4W is added to the cleaning agent of Example I to help in the degradation of hydrocarbons.

For example, one gallon of the cleaning agent of Example I is prepared. To this one gallon of cleaning agent is added 5 grams of BioBlend M-B4W. It is to be understood that higher or lower concentrations of BioBlend M-B4W could be also employed for specific applications. Additionally, BioBlend M-B4W can be in the form of a solid or a liquid nutrient broth.

BioBlend M-B4W is available from Waste Stream Technology, Inc. of Buffalo, N.Y. This bacterial culture contains a Pseudomonas unidentified fluorescens, a strain of aerobic pseudomonades adapted for their ability to degrade crude oil and other petroleum hydrocarbons in soil and water.

While BioBlend M-B4W is the preferred microorganism component of the cleaning agent of the present invention, it will be understood by those of ordinary skill in the art, that other bacterial cultures may be employed for this purpose. For example, hydrocarbon degrading microorganisms from the Bacillus, Arthrobacter and Pseudomonas genuses could be mixed with the neutral, non-toxic cleaning agent as prepared in Example I.

EXAMPLE III

The composition of the present invention was tested in an experiment conducted at a United Parcel Service vehicle maintenance facility located at Sharonville, Ohio. The purpose of the test was to determine effectiveness of the composition as a degreasing agent employed in vehicle parts washers and maintenance facility floor scrubbers. In addition, the tests were designed to determine the effectiveness of the cleaning agent composition where an on-site conversion of hydrocarbon contaminate was being performed by microorganisms in a microbial reactor integrated into the vehicle maintenance facilities waste stream.

In this example, there was noted a significantly improved speed of cleaning oils and greases from vehicle parts and the floor of the facility, and a significantly reduced cost per square foot of cleaned surface, as compared to other cleaning agents. Prior to installation, the oil content of waste water was 250,000 parts per million (ppm) or 25%. Within two weeks of operation, the bioreactor was discharging water with an oil content of 93 ppm. A week later, oil testing showed non-detectable levels. Over a three-month period, these low levels have been maintained, qualifying the discharge for sewer disposal. There is no need for relation of hazardous waste. For details of the test, refer to Appendix A.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

The nonylphenol ethoxylate is a non-ionic surfactant, and serves as a releasing agent to remove fats, oils, and greases from the surfaces of objects. The alkane sulfonate serves as a wetting agent to prevent the re-adherence of removed fats, oils, and grease to the surfaces. The water serves as a vehicle for transporting the nonylphenol ethoxylate and the alkane sulfonate.

APPENDIX A

U.P.S Ohio (Sharonville )

12/14/94

Sample ID# U-0-94-1 Results—250,000 PPM

Sample taken from Interceptor and Garage Area Sump-Sample mixed together.

Reactor installed

Heat 80° PH 8½ 3GPH

12/29/94

Sample ID# U-0-94-2 Results 93 PPM

Sample collected from Reactor Discharge.

Heat 80° PH7 3 GPH

1/10/95

Sample ID# U-0-95-3 Results ND

Sample collected from Reactor discharge.

Heat 59° PH 8½ 1 GPH

Reactor starting to plug up due to high solids in hydrocarbon waste.

1/16/95

Sample ID# U-0-95-4 Results ND

* Sample collected from Reactor.

Heat 80° PH7 IGPH

*=INTERCEPTOR sampling started

1/23/95

Sample ID# U-0-95-5 Results 18.4 PPM

Sample collected from Interceptor.

Coliwasa sampler used to obtain sample.

Heat 100° PH 9 3-GPH

* Note Scrubber was emptied two to four times due to excess floor dirt from trucks.

1/31/95

Sample ID# U-0-95-6 Results 19.6 PPM

Sample collected from Interceptor. Coliwasa sampler used to obtain sample.

Heat 81° PH6 3 GPH

* Note—Lost air line to Reactor. This caused microbe oxygen deficiency.

2/7/95

Sample ID U-0-95-8 Results 55.9 PPM

Sample Collected from Interceptor with a Coliwasa Sampler to obtain sample.

Heat 80° PH8 3-G-PH

* Note Reactor pulled and installed an air compressor for oxygen to microbes.

2/21/95

Sample ID# U-0-95-9 Results 69.8 PPM

Sample collected from Interceptor with a Coliwasa Sampler to obtain sample.

Heat 59° PH7 3-G-PH

* Note Air Compressor frozen and Reactor overflowing due to solids.

2/28/95

Sample ID# U-0-95-10 Results 614 PPM

Sample was collected from Interceptor with a Coliwasa Sampler to obtain a complete sample. Heat 80° PH 7 No Flow

* Note unpluged Reactor and added two small air pumps for oxygen to microbes.

3/7/95

Sample ID# U-0-95-11 Results 33 PPM

Sampler collected from Interceptor with a Coliwasa Sampler to obtain sample.

Heat—PH 8 0 GPH

* Note Reactor was down due to a plug in feed line. Took Reactor out and rearranged interior to stop pluging.

3/14/95

Sample ID3 U-0-95-12 Results

Sample collected from Interceptor with a Coliwasa Sampler to obtain sample.

Heat 60° PH 7 3 GPH

Note Readjusted air Lines in Reactor for solid dispensing.

MICROBIAL REACTOR TESTOGRAM

| UPS SHARONVILLE, OHIO | | | |
|---|---|---|---|
| DATE SAMPLE | SAMPLE # | RESULTS (PPM) | SAMPLE STATION |
| 12/14/94 | 94-1 | 250,000 | Interceptor |
| 12/29/94 | 94-2 | 93 | Reactor |
| 1/10/95 | 95-3 | ND | Reactor |
| 1/16/95 | 95-4 | ND | Reactor |
| 1/23/95 | 95-5 | 18 | Interceptor |
| 1/31/95 | 95-6 | 20 | Interceptor |
| 2/7/95 | 95-7 | 1140 | Interceptor |
| 2/15/95 | 95-8 | 59 | Interceptor |
| 2/21/95 | 95-9 | 70 | Interceptor |
| 2/28/95 | 95-10 | 614 | Interceptor |
| 3/7/95 | 95-11 | 33 | Interceptor |
| 3/14/95 | 95-12 | | Interceptor |

Note: ND = Non Detect

What is claimed is

1. A cleaning agent, consisting essentially of:

nonylphenol ethoxylate serving as a releasing agent to remove fats, oils, and greases from the surfaces of objects;

alkane sulfonate serving as a wetting agent to prevent the re-adherence of removed fats, oils, and grease; and water serving as a vehicle for mixing and transporting the nonylphenol ethoxylate and alkane sulfonate, wherein the foregoing ingredients comprise the following: about 5 grams of a pseudomonas species bacterial culture added to a composition comprising;

5% by volume nonylphenol ethoxylate 9.5 Mole;

2% by volume nonylphenol ethoxylate 4.0 Mole;

3% by volume alkane sulfonate; and

90% by volume water.

2. A method of preparing a neutral cleaning agent, comprising the steps of:

(a) adding two parts by volume of nonylphenol ethoxylate 4.0 Mole to 5 parts by volume of nonylphenol ethoxylate 9.5 Mole;

(b) adding three parts by volume of alkane sulfonate to the mixture of two parts by volume nonylphenol ethoxylate 4.0 Mole and five parts by volume of nonylphenol ethoxylate 9.5 mole as prepared in step (a); and (c) adding 90 parts by volume of water to the mixture as prepared in step (b).

3. The method of claim 2, further including preheating the nonylphenol ethoxylate 9.5 Mole, nonylphenol ethoxylate 4.0 Mole, alkane sulfonate and water to between about 80° F. and 115° F. to help in more uniformly combining these substances.

4. A neutral cleaning agent according to claim 1, wherein said substance containing a bacterial culture includes arthrobacter selected for its ability to degrade hydrocarbons.

5. The method of claim 2, further including the step of adding a sufficient amount of a substance containing a bacterial culture to help in degrading hydrocarbons.

6. The method of claim 5, wherein the step of adding a sufficient amount of a substance containing a bacterial culture includes adding 5 grams of a Pseudomonas species bacterial culture to one gallon of the prepared cleaning agent.

* * * * *